US012455141B2

(12) United States Patent
Ziliani et al.

(10) Patent No.: US 12,455,141 B2
(45) Date of Patent: Oct. 28, 2025

(54) METHOD AND SYSTEM FOR ESTIMATING THE POSITION OF THE POINT OF IMPACT BETWEEN A CLAY TARGET RELEASED FROM A LAUNCHING MACHINE AND A SHOT FIRED FROM THE SHOTGUN, CHOKE SELECTION BASED ON SAID ESTIMATE

(71) Applicant: FABBRICA D'ARMI PIETRO BERETTA S.P.A., Gardone Val Trompia (IT)

(72) Inventors: Giacomo Ziliani, Gardone Val Trompia (IT); Stefano Morzenti, Gardone Val Trompia (IT); Riccardo Zanardelli, Gardone Val Trompia (IT)

(73) Assignee: FABBRICA D'ARMI PIETRO BERETTA S.P.A., Gardone Val Trompia (IT)

( * ) Notice: Subject to any disclaimer, the term of this patent is extended or adjusted under 35 U.S.C. 154(b) by 5 days.

(21) Appl. No.: 18/572,250

(22) PCT Filed: Jul. 20, 2022

(86) PCT No.: PCT/IB2022/056664

§ 371 (c)(1),
(2) Date: Dec. 20, 2023

(87) PCT Pub. No.: WO2023/002378

PCT Pub. Date: Jan. 26, 2023

(65) Prior Publication Data

US 2024/0288248 A1 Aug. 29, 2024

(30) Foreign Application Priority Data

Jul. 20, 2021 (IT) ..... 102021000019196

(51) Int. Cl.
*F41G 3/26* (2006.01)
*F41J 5/12* (2006.01)
*F41J 9/32* (2006.01)

(52) U.S. Cl.
CPC ..... *F41G 3/26* (2013.01); *F41J 5/12* (2013.01); *F41J 9/32* (2013.01)

(58) Field of Classification Search
CPC ..... F41G 3/26; F41J 5/12; F41A 33/00; F41A 33/02; F41A 33/04; F41A 33/06
See application file for complete search history.

(56) References Cited

U.S. PATENT DOCUMENTS

| | | | | |
|---|---|---|---|---|
| 4,878,306 | A | 11/1989 | Dyer | |
| 2019/0186876 | A1 | 6/2019 | Howe | |
| 2021/0270567 | A1* | 9/2021 | Pautler | F41G 1/54 |

FOREIGN PATENT DOCUMENTS

| | | | |
|---|---|---|---|
| WO | 2020006095 | A1 | 1/2020 |
| WO | 2021111209 | A | 6/2021 |

OTHER PUBLICATIONS

International Search Report, issued in PCT/IB2022/056664, mailed Oct. 7, 2022, Rijswijk, NL.

* cited by examiner

*Primary Examiner* — Timothy A Musselman
(74) *Attorney, Agent, or Firm* — ArentFox Schiff LLP; Michael Fainberg

(57) ABSTRACT

A method for selecting a choke from among a plurality of chokes to be applied to a barrel of a shotgun during a skeet shooting session is provided. The method involves firing at least one shot, after each shot fired, estimating a position of a point of impact between a clay target released from a launching machine and a shot fired from the shotgun of a shooter, calculating an impact distance between a position of the shooter and the estimated position of the point of impact, and selecting the choke as a function of the impact distance or of an average of impact distances obtained from a plurality of estimates of positions of the point of impact made after each one of a plurality of shots.

13 Claims, 8 Drawing Sheets

METHOD AND SYSTEM FOR ESTIMATING THE POSITION OF THE POINT OF IMPACT BETWEEN A CLAY TARGET RELEASED FROM A LAUNCHING MACHINE AND A SHOT FIRED FROM THE SHOTGUN, CHOKE SELECTION BASED ON SAID ESTIMATE

CROSS-REFERENCE TO RELATED APPLICATIONS

This application is a National Phase Application of PCT International Application No. PCT/IB2022/056664, having an International Filing Date of Jul. 20, 2022 which claims priority to Italian Application No. 102021000019196 filed Jul. 20, 2021, each of which is hereby incorporated by reference in its entirety.

FIELD OF THE INVENTION

The present invention regards the sector of the sporting practice of skeet shooting and refers in particular to a method and a selection system for selecting a choke from among a plurality of chokes to be applied to the barrel of a shotgun during a skeet shooting session.

In particular, the selection method and system that is the object of the invention are based on an estimate of the position of the point of impact between a clay target released from a launching machine and a shot fired from a shotgun of a shooter in a skeet shooting session.

STATE OF THE ART

During the practice of the sporting disciplines of skeet shooting, the athletes and their coaches are interested in several quantities that, aside from the result of the shot, permit evaluating and quantifying the characteristics and the correctness of the action. Some of these quantities may be obtained from the instrumentation that controls the machines in the area, for example the shooting times of the first and second barrel and the identification of the released clay target.

Other quantities that might nevertheless be of interest would instead require the use of measurement instrumentation or of dedicated devices that usually are unavailable. This makes it so that the greater source of information for coaches and athletes still originates still today from a direct and qualitative observation of the shooting event, with strong dependence on the personal experience of the observer him/herself.

The position of the clay target at the instant it is hit by the shot column of pellets is surely among the quantities of interest. This information makes it possible to estimate whether the clay target ended up being hit, the orientation of the shotgun at the shooting instant and at what distance the clay target was located, making it possible, for example, to establish what type of choke to use in order to determine an optimal shot column at the distance of impact.

The selection of the correct choke is important inasmuch as the athletes in general have a characteristic reaction time, which is reflected in a specific impact distance, i.e., the distance between the shooter and the point at which the impact between the shot column and the clay target occurs.

The position of the clay target usually is not known unless sophisticated equipment, such as a camera or radar system is used. The clay targets are relatively small (around 110 mm in diameter) and leave the machine at a sustained speed, for example, over 100 km/h. This means that a system that is able to measure their position requires significant capabilities. Even so, this incurs costs related to instrumentation equipment, which must be installed, maintained and used in the appropriate manner.

SUMMARY OF THE INVENTION

The object of the present invention is to permit a selection of an optimum choke f among a plurality of possible chokes to be applied to the barrel of a shotgun for skeet shooting based on the distance between the point of impact between clay target and shot and position of the shooter, yet without requiring the use of a dedicated instrumentation device.

Such object is achieved by a method for selecting a choke and a selection system as described and claimed herein. Preferred or advantageous embodiments of the method and of the system according to the present invention are also described.

In the case of Olympic sports, like trap, skeet or other disciplines, like universal trench, the trajectories of the clay targets that may be presented to the athlete are defined by technical rules standardized by the international or national federations. These rules establish some constraints that the trajectories of the clay targets must comply with. For example, in trap, the following are standardized:

- the angulation with respect to the sagittal plane;
- the transit height of 10 m from the clay target launching machine (elevation);
- landing distance (drop).

Furthermore, geometries and masses of the clay targets themselves are defined. This information makes it possible for trajectories to be calculated a priori with a certain degree of tolerance using aerodynamic models or direct measurements made just once with dedicated instrumentation. The knowledge of the position of the clay target, understood as trajectory and law of motion (position in time), makes it possible to establish the assumed position of the clay target at the instant of impact if the time between the release of the clay target and the shot (reaction time) is known.

With there being no necessity of dedicated instrumentation, this method of calculation of the assumed position of the clay target when it is hit by the shot is advantageous, because it makes the estimation of the position of the clay target very economical.

According to one aspect of the invention, the estimate of the position of the clay target makes it possible to carry out an automatic selection of the optimum choke to be applied to the barrel of the shotgun from among a plurality of available chokes.

Therefore, a method for selecting a choke from among a plurality of chokes that may be applied to the barrel of a skeet shooting session constitutes an object of the present invention and comprises the following steps:

- firing at least one shot;
- after each shot fired, estimating the position of the point of impact between a clay target released from a launching machine and a shot fired from shotgun of the shooter;
- calculating the impact distance between the position of the shooter and the position of the estimated point of impact;
- selecting a choke as a function of said impact distance or as a function of an average of impact distances obtained from a plurality of estimates of the position of the point of impact made after each one of a plurality of shots made.

The estimate of the point of impact is obtained with a method for estimating the point of impact comprising the steps of:

acquiring a trajectory model of the clay target;

acquiring the release time of the clay target from the launching machine;

acquiring the shot time;

obtaining the reaction time as the difference between the release time and the shooting time;

obtaining the spatial coordinates of the point of impact on the trajectory model at an impact time that includes the reaction time.

Furthermore, a selection system for selecting a choke from among a plurality of chokes that may be applied to the barrel of a shotgun during a skeet shooting session constitutes an object of the present invention and comprises:

a trajectory model acquisition module configured for acquiring a trajectory model of the clay target;

devices for detecting shooting parameters configured for detecting at least the release time of the clay target from the launching machine and the shooting time;

processing means operationally connected to the model acquisition module and to the devices for detecting shooting parameters and configured for:

obtaining the reaction time as the difference between the release time and the shooting time;

obtaining the spatial coordinates of the point of impact on the trajectory model at an impact time that includes the reaction time;

selecting a choke as a function of said impact distance or of an average of impact distances obtained from a plurality of estimates of the positions of the point of impact made after each one of a plurality of shots made.

The position of the clay target at the instant of the shot may also supply further quantities of interest for the shooter. Among these is the measurement of the kinematics of the shotgun. In fact, according to another aspect of the invention, knowing the assumed position of the clay target and that of the shooter, in the case of a clay target being hit, it is possible to estimate the orientation of the shotgun at the instant of the shot and, if the release time of the clay target and the shot is known, to estimate the average speed as displacement divided by time.

In one embodiment, also the average speed of the shotgun when tracking the clay target may be utilized by the processing means for selecting—in combination with the datum for distance between clay target point of impact and shooter—the most appropriate choke for a specific shooter.

This method is advantageous inasmuch as it does not require instrumentation as an additional measure. Clearly the method requires a mechanism for knowing the result of the shot in the event that it is a training session, for example, the management system of a skeet shooting session described in WO2021111209A1 in the name of the same Applicant.

The system described in WO2021111209A1 comprises hardware and software means for session monitoring and an user interface operationally connected to such monitoring hardware and software means, in which the user interface comprises a plurality of user pushbuttons, which may be pushed by a user following the execution of a shot. Such plurality of pushbuttons comprises a first pushbutton for a missed clay target, a second pushbutton for second barrel made shot and a third pushbutton for no-target. The hardware and software monitoring means are configured for:

receiving signals of pushbutton activated by the respective user pushbuttons, receiving a voice command signal from a voice command detection device, receiving a shot taken signal, commanding the release of a clay target, memorizing a series of data related to a shot taken.

When the no-target pushbutton is pushed, the hardware and software means are further configured for:

verifying if the data memorized before the no-target pushbutton is pressed include at least one of the following: a datum related to the shot taken signal, a datum related to the pressing of the second barrel shot made pushbutton, a datum related to the pressing of the clay target missed button;

in the negative case, overwriting the series of data related to the shot subsequent to the pressing of the no-target pushbutton with the data memorized before the no-target pushbutton was pushed;

in the affirmative case, keeping memorized the series of data memorized before the no-target button was pressed and identifying as a repeated shot the series of data related to the shot subsequent to the pressing of the no-target pushbutton.

In one embodiment, the series of data related to the shot taken comprise one or more among: shot number within a predetermined shooting session, points obtained, sequence of the clay targets within the session, direction of release of each individual clay target within the session, result of the shot for each individual clay target belonging to the series understood as a made shot, shot not made or second barrel shot made, delayed release of the clay target from the call, time interval between the release of the clay target and first shot, time interval between first and second shot, no-target signal.

According to another aspect of the invention, the possible estimated trajectories that will be presented once the pattern of the discipline and the platform occupied are known are displayed for the shooter. In fact, as of today the shooter knows only the constraints that the trajectories have to comply with (indicated on the tables of the technical rules), but only the more expert shooters succeed in imagining, by mentally visualizing, how the trajectory will appear.

In one embodiment, the information that may be obtained with the above-described methods are accessible by the user using an app by smartphone and therefore directly accessible in the area a few instants before the start of the shooting session.

In some embodiments, the clay target trajectory data and/or orientation of the shotgun are rendered more accessible by means of 3D display functionality, in which the point of view may be modified by the user.

Therefore, the invention proposed, based on the technical rule, which defines the specifications of the clay targets, supplies an alternative method for the estimation of their trajectories.

With the estimated trajectories, it is possible to perform:

1. Calculation of the position of the clay target at the instant of impact and of the shot: supplies statistical information to the athlete for the spatial location of the hit and missed clay targets, and as a result information on the typical engagement distance, with the resulting possibility of optimum selection of the choke employed. The method of calculation does not require measuring instrumentation equipment for the user as long as the pattern, the activated machine and the reaction time are known.

2. Graphical display of the trajectories: permits the display of the possible clay targets of a pattern in a clearer and more intuitive mode than the typical angle-height-distance table defined by rules. This therefore permits improving the preparation for the shot.

3. Calculation of the position of the shotgun at the instant of the shot: reconstruction of quantities of interest that describe the movement of the shotgun without the necessity of appropriate instrumentation installed on the shotgun itself or in the shooting area.

In addition, with the angular displacement and the reaction time known, it is possible to calculate the average speed of the shotgun when tracking the clay target.

BRIEF DESCRIPTION OF THE DRAWINGS

The features and advantages of the invention will become nevertheless apparent from the description below of its preferred embodiments, given by way of indicative and non-limiting example, with reference to the attached figures, wherein.

DETAILED DESCRIPTION

Figure 1:
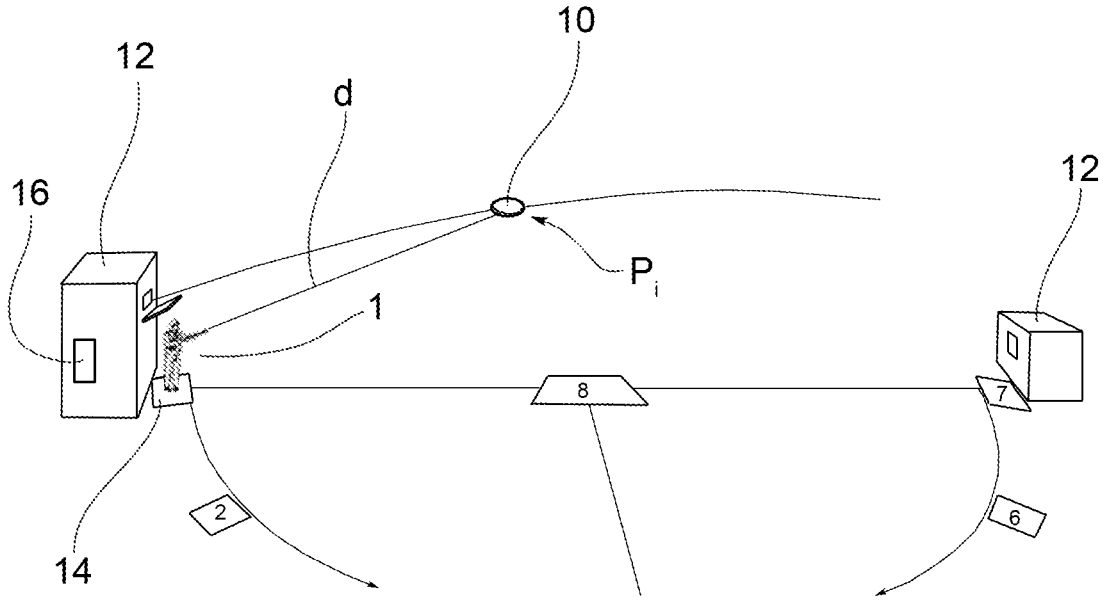
FIG. 1 is a diagram of a shooting session of the skeet discipline.

As is known, clay target is a sporting discipline that consists in hitting a moving target (the clay target 10 in the FIG. 1), by means of a smooth bore shotgun, from a predetermined distance with respect to a clay target launching machine 12, which carries out the launch of the clay target 10. The shooter 1, positioned on an appropriate shooting platform 14, arbitrarily decides when to cause the clay target to launch, vocally emitting a strong and brief conventional sound, generally the word "pull."

The practice of skeet shooting is conducted within the specialized structure called "TAV" (skeet shooting), where one or more plants are present, said shooting areas, which include one or more traps 12 for release of the clay targets to be hit, managed by a related electronic control unit 16.

Each discipline establishes how the shooting activity is conducted. In particular, the number and type of clay target released, the release position, the direction, two points of passage on a plane and the angulation of said plane with respect to the sagittal plane of the area may be specified.

The electrical control units are tasked with controlling the various machines for releasing the clay targets on the basis of specific dictated sequences of the discipline following a voice command given by the shooter.

Each area may be equipped with various platforms (depend on the discipline) that are occupied in turn by the shooters; the rotation of the shooters on the various platforms is binding and established by the discipline. Each platform is equipped with a device adapted to vocally activating the release of the clay target, called "phonopull."

There may be present in the area one or more monitors that make it possible to display, for example, the progress of the released clay targets within a shooting session (usually made up of 25 clay targets), the result of the shots (clay targets hit or missed) and, by some control unit technologies, the release direction of the clay targets (Right Central Left).

Some control units also make it possible to measure and visualize on a display installed in the shooting area the reaction time, meaning time interval that exists between the release of the individual clay target and the shot. This information is usually displayed for several instants between one shot and the next one.

Some control units have at their disposal possibilities for transmitting data detected from the shooting area to any official station that may be present in the TAV, where the same data displayed on the areas are reproduced and where there may be a PC adapted to collect the shooting data during the competitions for the purpose of producing the standings. The name of the shooter in this case is manually inserted during the registration step of the competition.

As is known, the shotguns for skeet shooting may be equipped with a choke applied to the end of the barrel in order to determine the breadth of the shot column coming out of the barrel.

For each shotgun, there are as many chokes available as determine widths of shot column. Usually, the choking levels are indicated with the number of stars. The greater the number of stars, the less the choking. For example, 5 stars is equivalent to an unchoked (cylindrical) barrel.

The choking acts on the pellets, concentrating the exiting shot column, then permitting the density of the pellets to be greater at a greater distance.

The choice of the choke is the fruit of a compromise, inasmuch as a shot column that is too narrow requires greater precision (the diameter which intercepts the clay target is less), while a shot column that is too wide could be less "dense with balls;" therefore, even though intercepting the trajectory of the clay target, no pellet hits it.

Clearly, therefore, the choking level is strictly tied to the distance between the position of the shooter and the point at which the rupture of the clay target occurs. For example, it is established that:

- if the typical clay target rupture distance ranges between 25 and 35 meters, it is appropriate to install a 3-star choke;
- if the distance ranges between 30 and 40 meters, it is appropriate to install a 2-star choke;

if the distance ranges between 40 and 50 meters, it is appropriate to install a 1-star choke.

According to one aspect of the invention, a method is proposed for selecting the choke that is most appropriate based on an estimate of the position of the point of impact, "Pi," between a clay target 10 released from a launching machine 12 and a shot fired from a shotgun of a shooter 1 in a skeet shooting session.

In a general embodiment, the method of estimating the point of impact comprises the steps of:

acquiring a trajectory model of the clay target;

acquiring the release time of the clay target from the launching machine;

acquiring the shot time;

obtaining the reaction time as the difference between the release time and the shooting time;

obtaining the spatial coordinates of the point of impact on the trajectory model at an impact time that includes the reaction time.

In one embodiment, the trajectory model of the clay target is a physical model that describes the aerodynamic behavior of the actual clay target, the mass and geometry of which are known, and which takes account of any boundary conditions set by the rules and/or measured, for example, the release speed and the density of the air. Some of these boundary conditions may be detected by means of measurement instrumentation with which the traps may be equipped.

In one embodiment variant, the trajectory model of the clay target is a parametric mathematical model, the parameters of which are appropriately calibrated in order to generate trajectories and laws of motion.

In the context of this explanation, parametric mathematical model means that the function of the model is a generic function, i.e., independent from its physical meaning (for example a polynomial of a sufficiently high degree), but its coefficients are set in such a way that the calculation of such a function describes the trajectory of the clay target in space and time (with a degree of tolerable error). In practice, the described trajectory of the physical model, calculated just once, could be reproduced with a certain degree of error by a mathematical function, which makes it a "best fitting."

An advantage of this solution consists in the fact that the number of parameters necessary to describe the mathematical function could be less than that which is necessary to describe the physical model. This therefore makes for a lesser quantity of data for defining the possible trajectories and the computational complexity required of the server which is required to calculate the position, for example immediately after the shot, could be less once the time and type of clay target are known.

In some embodiments, various mathematical functions are obtained as a function of different trajectories—for example mentioned above—that are variable based on the boundary conditions. For example, the mathematical functions may be implemented with polynomials of various degrees and/or based on various physical models, which differ not just in the parameters, but in the type of equations used for describing the trajectories.

In other embodiments, instead, a unique model of the parametric type is used where that which varies from one model to the other are just the parameters. In this case, therefore, a unique mathematical function may be obtained that approximates in the best mode ("best fitting") the trajectory of the clay target and with a different set of parameters for each clay target.

In a further possible embodiment, the trajectory of the clay target could be obtained from a tabling of position coordinates of the clay target as a function of time (with time steps, for example every hundredth of a second) calculated just once as a function of the physical model of the trajectory. In this case, the computational load would be low (given that the position is already calculated and it is sufficient to restore the value corresponding to the shooting time), but, as a function of the time resolution, the trajectories could require more memory space.

In a further embodiment, the trajectory model is obtained by directly measuring the actual trajectory.

As mentioned above, the technical rules define the possible trajectories in a very schematic mode, by means of imposing two points of passage on a plane and the angulation of such plane with respect to the sagittal plane of the area. If the geometry and the mass, standardized, of the clay targets are added thereto, and any further constraints imposed by the rules, for example the release speed, from which a repeatable aerodynamic behavior ensues, and a further point of passage in the trap 12 (the position of which is likewise regulated), the trajectories of the clay targets are predictable and they adapt well to a modeling process.

Therefore, according to an aspect of the present invention, the trajectories are not measured directly, but are estimated with a pre-calculated model.

Figure 2:
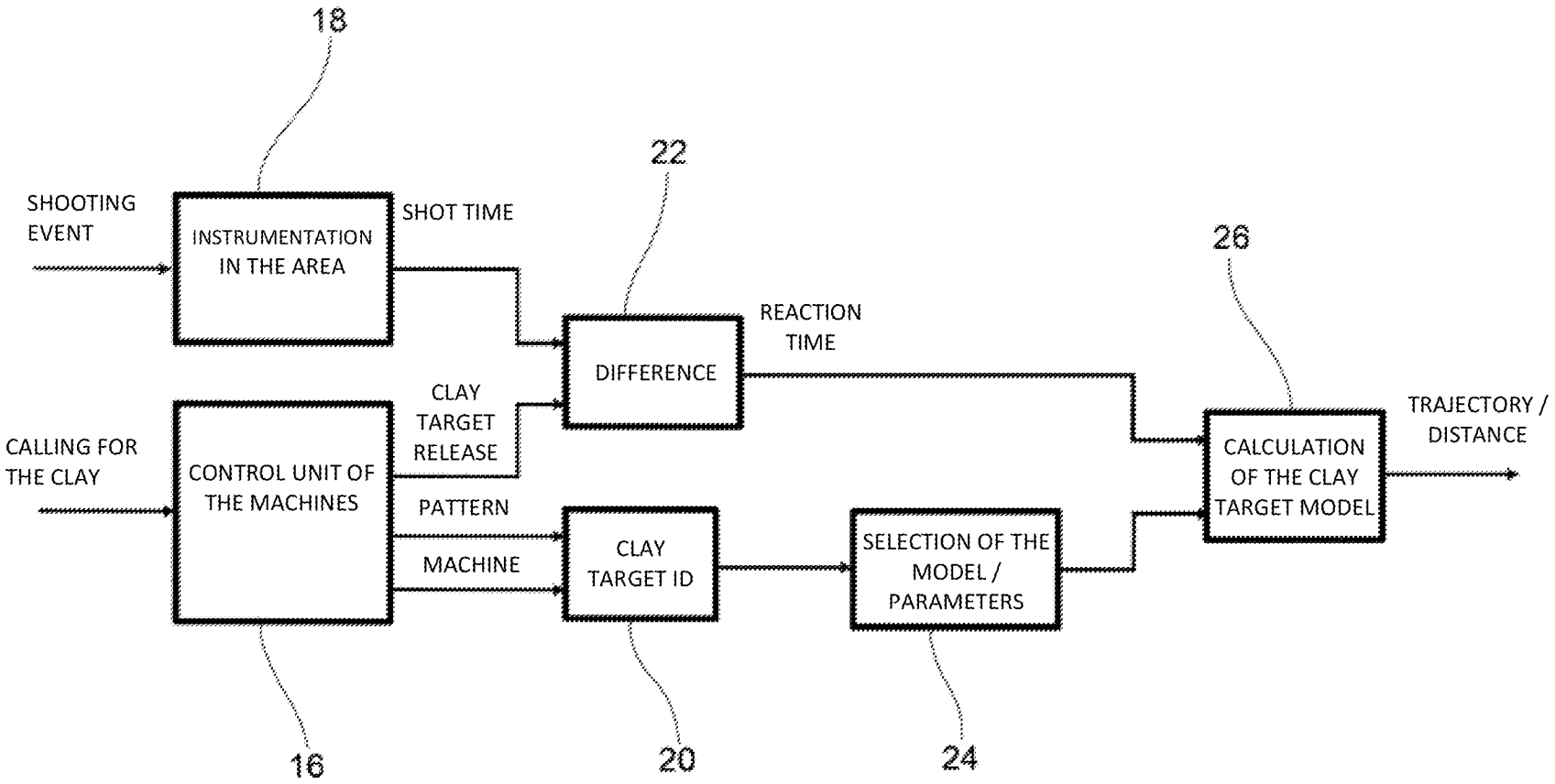
FIG. 2 is a block diagram of the calculation method of the trajectory model of a clay target, according to an embodiment of the invention.

With reference to the flow chart of FIG. 2, in one embodiment the position of the clay target 10 is calculated at the instant of the shot through the following steps:

1) Upon release of a clay target 10 and upon execution of a shot, data regarding the shooting pattern, the trap 12 and the reaction time are generated. In particular, the combination of shooting pattern and trap may define the characteristics of the clay target (ID clay target 20). The reaction time "Tr" (difference 22) is the time interval between the release time of the clay target "Tl" (supplied by the control unit of the machine 16) and the shooting time "Ts" (supplied by the instrumentation in the area 18).

On the basis of information of the launched clay target (20), a specific trajectory model or a set of parameters to be assigned to a generic parametric trajectory model is selected (selection step 24). As mentioned above, the model may also be obtained by directly measuring the actual trajectory, for example with a system of vision, or a radar system, or a measurement system capable of tracking the kinematics of the clay target in flight.

The calculation of the selected model at the reaction time supplies the coordinates of the clay target with which it is possible to display or annotate the position and calculate the distance "d" from the shooter (calculation step 26). The distance "d" from the shooter clearly depends on the geometry of the area (regulated by rules) and on the shooting station occupied by the athlete at the instant of the shot, which may be information that is manually supplied or reconstructed on the basis of the shooting sequence, if the starting station is known.

In one embodiment, the impact time "Ti" is the sum of the reaction time "Tr" and the shot flight time "Tv."

In fact, the calculation of the trajectory at the reaction time indicates the position of the clay target (and its distance from the shooter) at the instant of the shot. However, in order to know the position and distance of the clay target at the instant of impact with the shot, it is necessary to consider the speed of the shot, which is finite and variable over time.

The method proposed by the calculation of the flight time relies on the available information of trajectory and law of motion of the clay target, shooting instant and law of motion of the shot.

In one embodiment, a choice was made not to consider the trajectory of the shot inasmuch as it would require a measurement of the direction of the shotgun when fired and a complex modeling. However, this is not a limit inasmuch as the calculation of the distances as a function of the time for the two objects (clay target and shots) with respect to a same point (the shooter) is sufficient to identify the instant in which the shot potentially reaches the clay target, leaving instead the assessment of the effective correctness of the aim to the result of the shot, which may already be recorded in other ways. This relies on the assumption that the trajectory of the shot is straight (a more accurate modeling requires knowing the direction of the gravity vector in relation to the speed vector, i.e., measurement of the state of the shotgun when fired); however, this approximation is acceptable given the typical timeframes of the disciplines involved.

Figure 3:
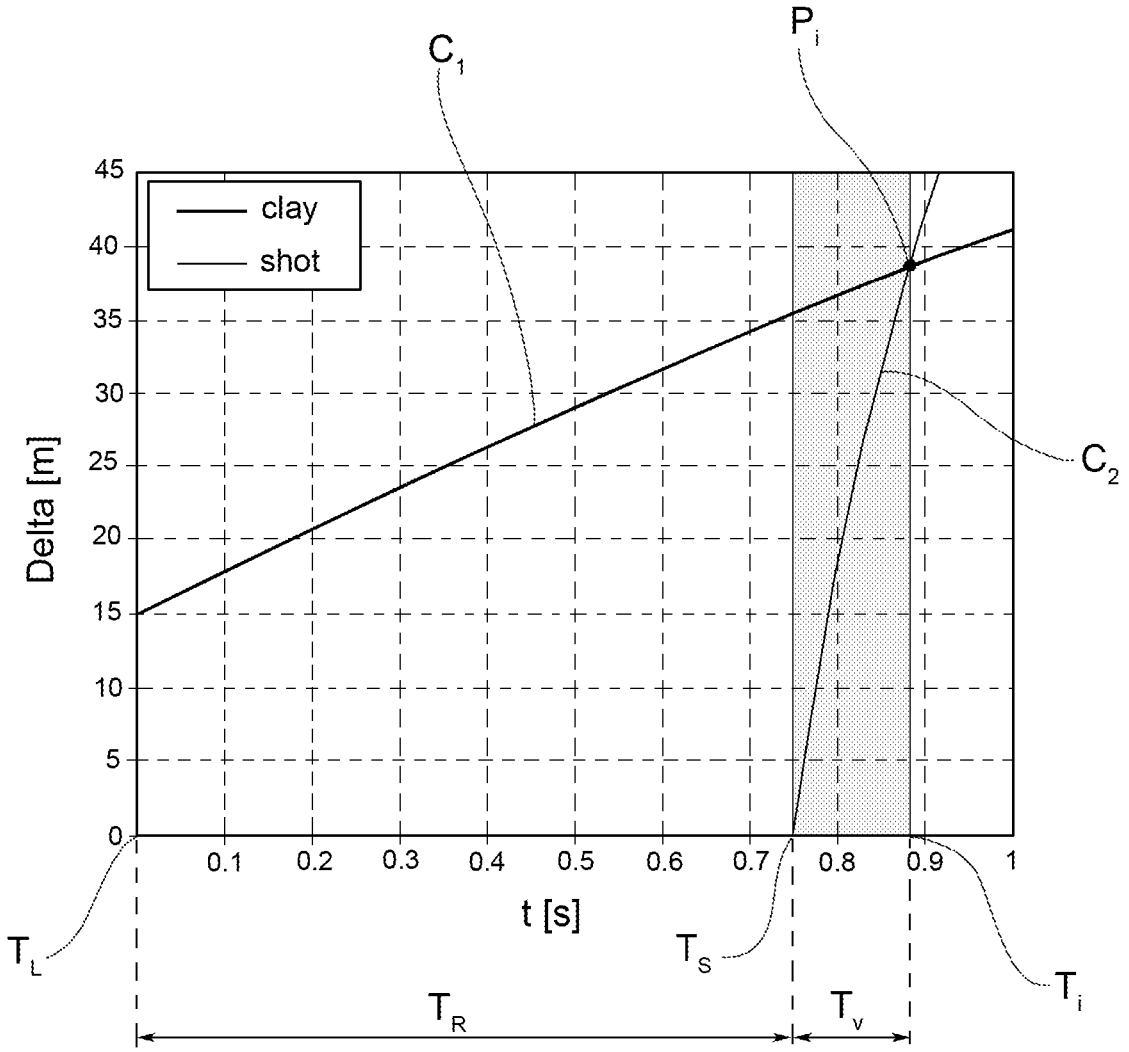
FIG. 3 is a time-distance diagram that shows the intersection between the curves that represent the laws of motion of a clay target and of a shot.
Figure 4:
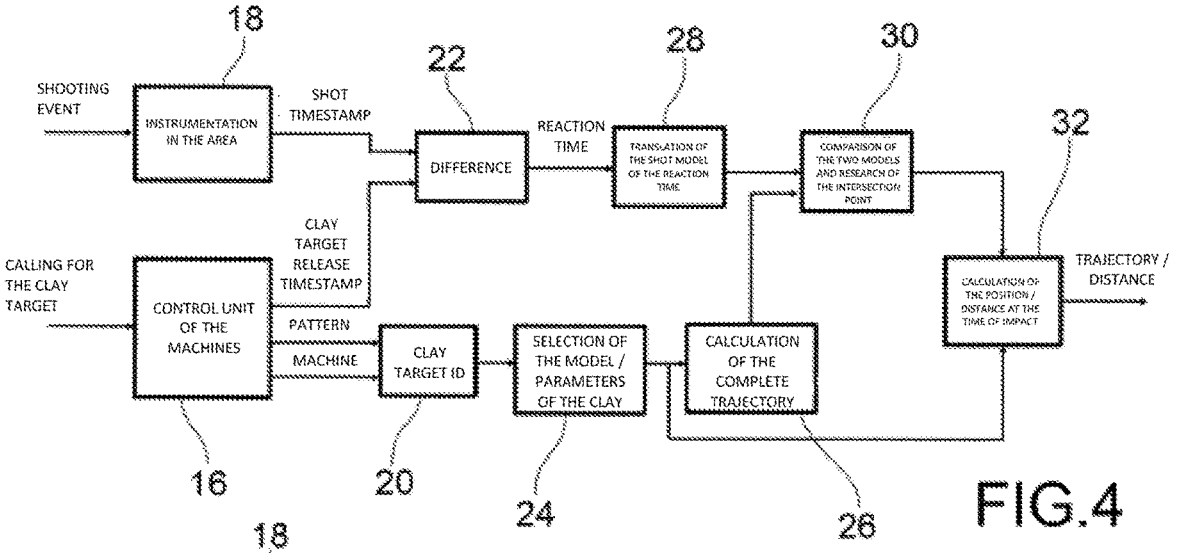
FIG. 4 is a block diagram of the calculation method of the point of impact in an embodiment that takes account of the shot flight time.

As illustrated in the graph of FIG. 3 and in the flow chart of FIG. 4, the model of the shot must be able to describe the distance from the starting point as a function of time in such a way as to be able to compare it to the distance of the clay target as a function of time. The distance of the shot must be translated, on the axis of time, of the reaction time Tr (translation step 28 of the model of the shot). The intersection (step 30) between the curve C1, which represents the trajectory of the clay target 10, and the curve C2, which represents the trajectory of the shot, makes it possible to identify the instant of potential impact Ti (step 30), and consequently to calculate the quantities of interest at that instant (step 32).

Figure 5:
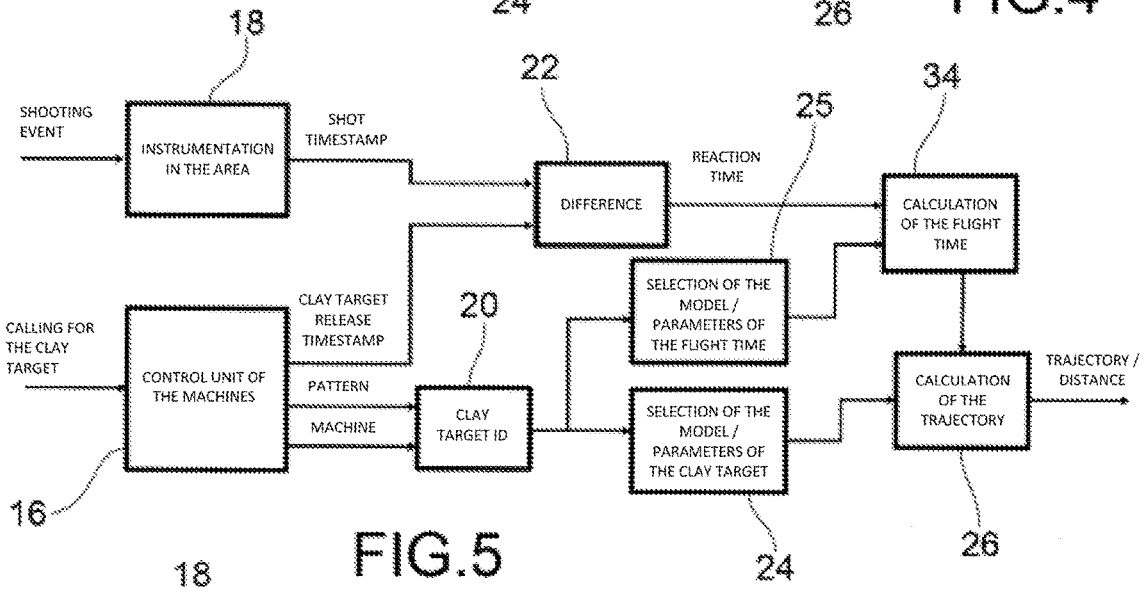
FIG. 5 is a block diagram of the calculation method of the point of impact, in a further embodiment variant.

In an embodiment variant illustrated in the flow chart of FIG. 5, the shot flight time, Tv, is calculated (step 34) for various shooting instants for each clay target in such a way as to construct functions which express the flight time or the impact time as a function of the shooting time.

The sequence of operations for the correction of the flight time with pre-calculated model is shown in the diagram in FIG. 5. In this case, compared to the method previously described with reference to the flow chart of FIG. 4, it is not necessary to compare the two distances (clay target-shooter and shot-shooter) but a family of functions is available that express the flight (or impact) time as a function of the shooting time.

It is necessary to utilize a family of functions inasmuch as each clay target distances itself from the shooter at a different rhythm because of the different initial speed, angulation and elevation.

Upon identification of the clay target ID (step 20), both of the trajectory models of the clay target (step 24) and flight time (step 25) are selected. The first serves for the direct calculation of the trajectory of the clay target (step 26), while the second makes it possible, when the reaction time is known, to know the impact time (step 34). If the trajectory and the impact time are known, the coordinates of the point of impact Pi and therefore the distance of the clay target hit by the shooter are obtained.

In view of a more time-consuming preparation, this embodiment variant of the method offers a more direct calculation of the model of the clay target, without the need for comparing it to the kinematics of the shot.

Now methods will be described for estimating the position of the clay target at the instant of impact with the shot in the particular case of the American trap discipline.

This discipline does not define the clay targets with the same criteria as the Olympic disciplines. Instead of tables of configuration values of the machines, in this case the machine is unique and its setting (speed of launch and angle of elevation) is fixed.

In a manner similar to the Olympic disciplines, the rules pose some limits to the landing distance (min 49 yards, max 51 yards) and the transit height at the distance of 10 yards from the machine (min 8 feet, max 10 feet, suggested 9-9.5 feet). The angulation with respect to the sagittal plane is instead variable up to a maximum of ±27° and not predictable (see FIG. 1*a*). The trap is in fact in irregular movement around a vertical axis X, in such a way that the angulation of the clay target is dependent on the time instant in which it is called and released and not predictable.

Therefore, a family of models cannot be constructed a priori for this discipline. The following methods are proposed.

Figure 2A:
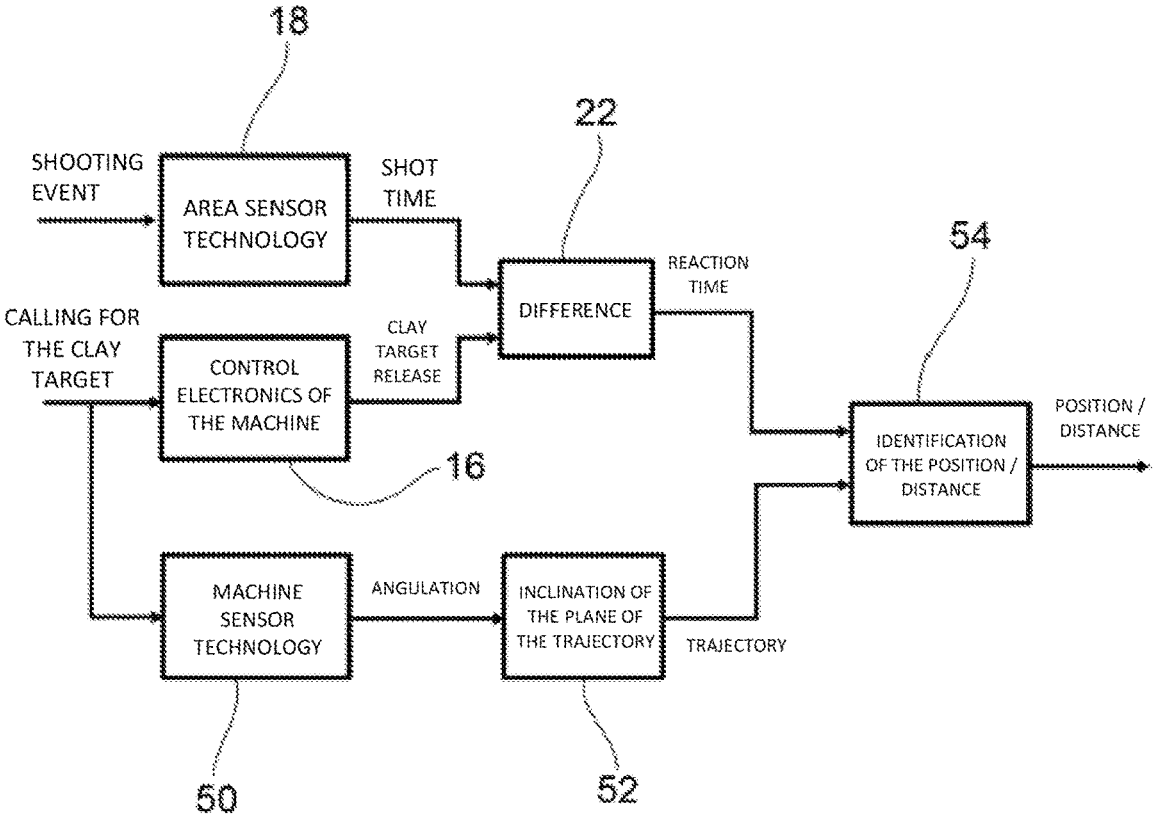
FIG. 2*a* is a block diagram analogous to the preceding one, referring in particular to the American trap discipline.

A first method, illustrated in the flow chart of FIG. 2*a*, provides for the use of a planar model of the clay target that describes the trajectory and the law of motion according to the specifications imposed by rules (for example, distance and altitude at 10 yards). The term "planar model" is understood to mean a model that describes the trajectory of the clay target in the plane in which the trajectory C1 lies, as illustrated in FIG. 2*c*.

In one embodiment, this method requires the use of a sensor 50 for the measurement of the angulation $\alpha$ of the machine with respect to the central axis Y of the area (called "centerline" in jargon) and therefore of the angle between the plane in which the planar trajectory C1 lies and the sagittal plane passing through the central axis Y (step 52).

Analogously to the methods previously described, the reaction time (step 22) is calculated for estimating the position of the clay target, and therefore its distance from the shooter, at the instant of the shot (step 54).

Figure 2B:
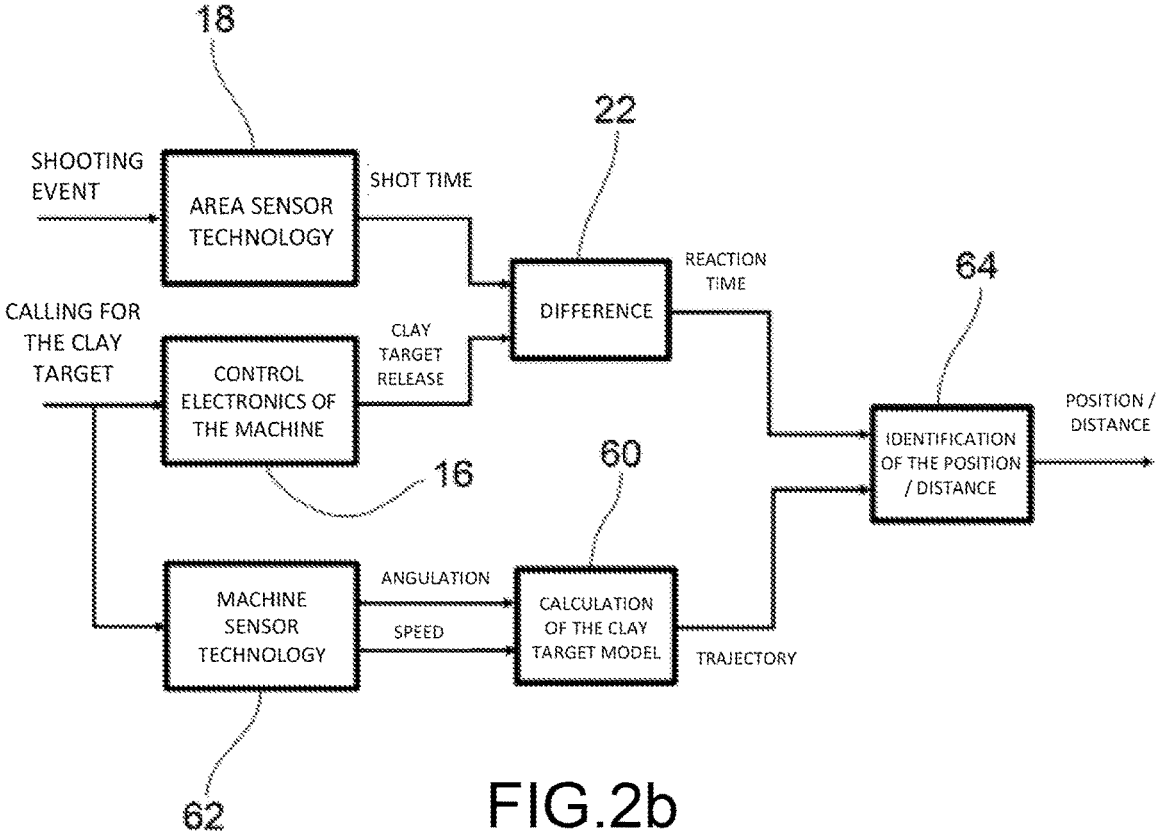
FIG. 2*b* is a block diagram of an embodiment variant of the calculation method, again in the case of American trap.
Figure 2C:
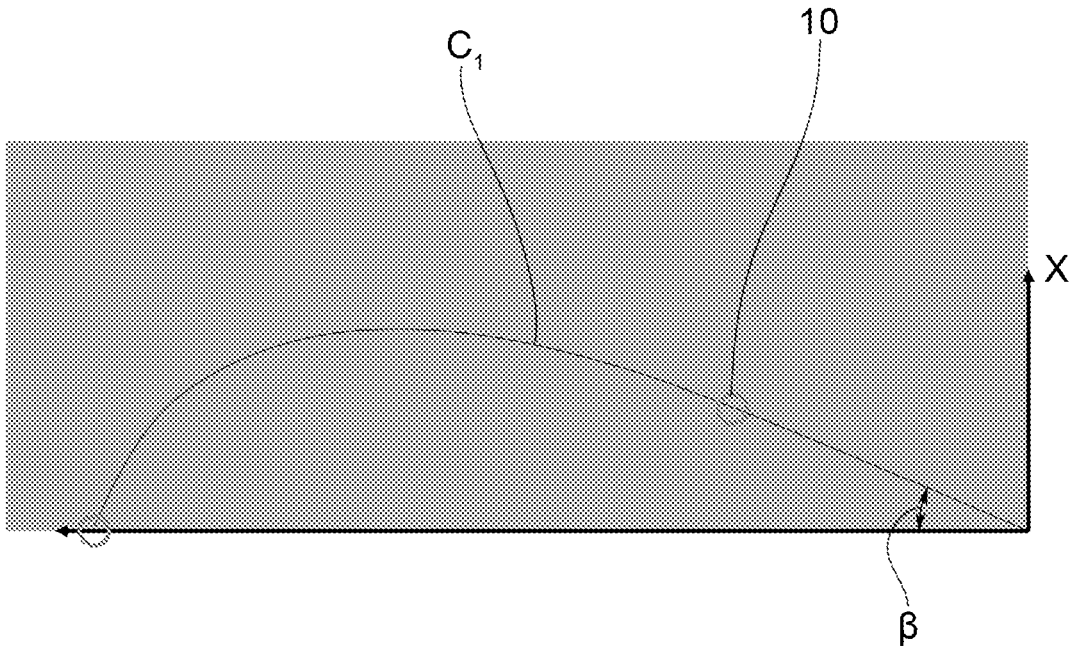
FIG. 2*c* is a diagram of a planar model example of a trajectory of a clay target.

A second method, illustrated in the flow chart of FIG. 2*b*, provides for the use of a physical model of the clay target (calculation of the clay target model step 60) which describes the trajectory and law of motion starting from a set of initial conditions.

The initial conditions may comprise the speed vector of the clay target exiting the trap (therefore, the direction and the value of the output speed from the machine), mass and geometry of the clay target and any known external factors.

Figure 2D:
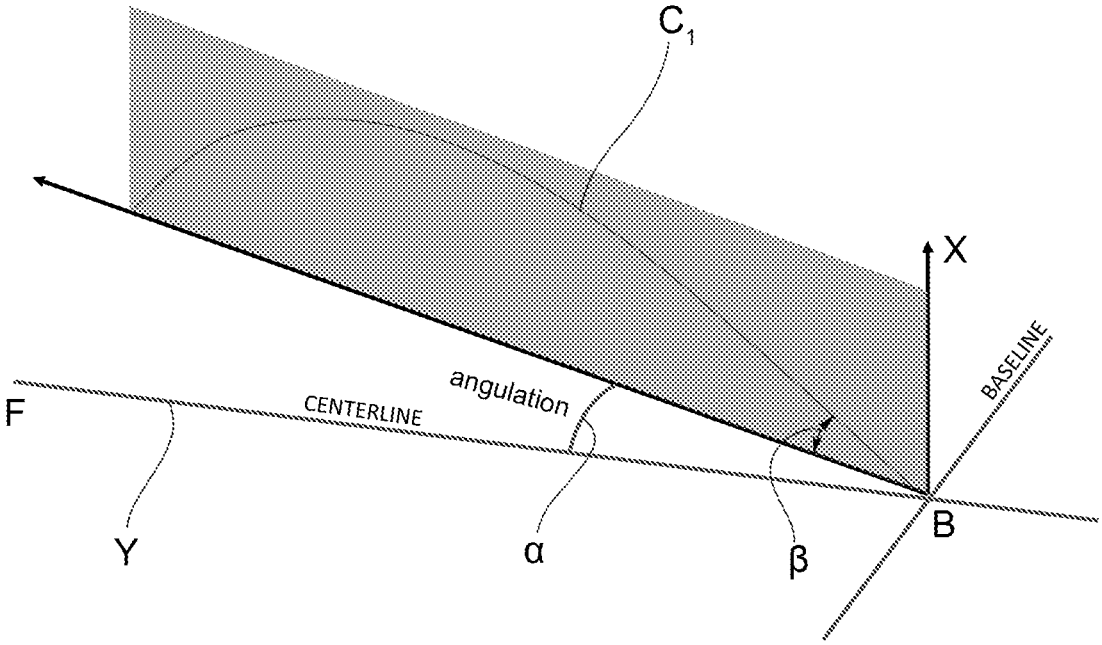
FIG. 2*d* is a diagram that shows, for example in the case of American trap, the angulation of the trajectory on a horizontal plane, that is, with respect to the central axis of the area, and on a vertical trajectory plotting plane.

With reference to the diagram of FIG. 2*d*, the direction of the output speed vector of the clay target is defined by the horizontal angulation, i.e., the angle $\alpha$ defined above, i.e., the angle between the plane in which the trajectory of the clay target lies and the sagittal plane passing through the central axis Y, and by the vertical angulation, i.e., the lifting angle $\beta$ of the clay target exiting the machine.

This second method therefore requires the use of sensors (62) for the measurement of the horizontal $\alpha$ angle of the machine, of the vertical angle $\beta$ of the machine and of the release speed.

The method therefore requires an application of the measured initial conditions to the model for the calculation of the trajectory.

Analogously to the methods previously described, the reaction time (step 20) is calculated for estimating the position of the clay target, and therefore its distance from the shooter, at the instant of the shot (step 64).

Both the proposed methods require knowledge of some quantities that may be obtained by equipping the machines (for measuring angulations, initial speed) and the area (for detecting the instant of the shot) with appropriate instrumentation, or interacting with the control cabinet of any machines already equipped with such instrumentation.

Figure 1A:
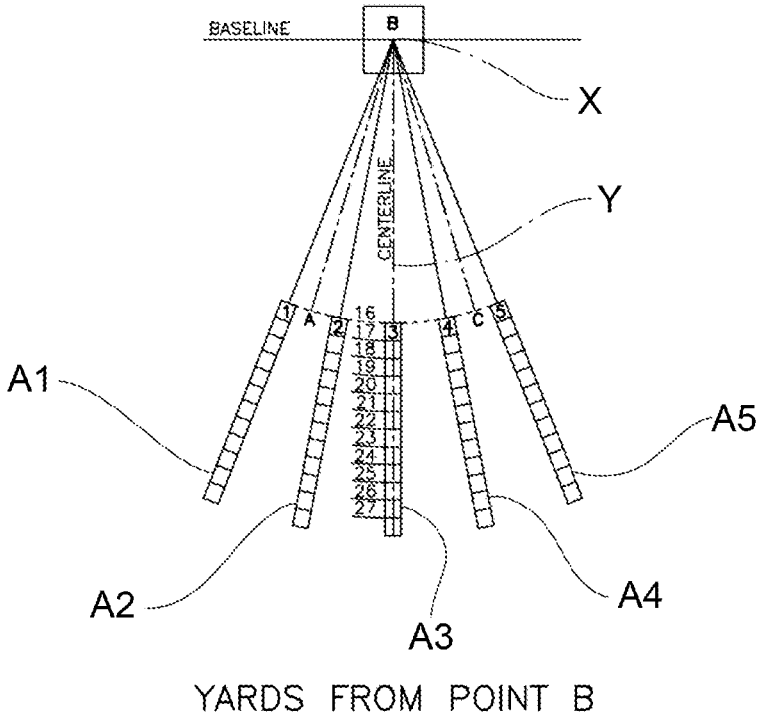
FIG. 1*a* is a diagram that shows the shooting area and the shooting positions of the American trap discipline.

With reference to the diagram of FIG. 1*a*, in order to be able to introduce the correction of the estimate of the position of the clay target given by the shot flight time, it is necessary to know the position of the athlete with respect to the machine, which is variable according to the rules. In fact, in American trap, the athlete may be positioned at a variable distance from the machine between 16 and 27 yards, along five possible angulations A1-A5 with respect to the central axis Y of the area. The variation of distance makes it possible to change the difficulty of the shot for the athlete.

The information on the position of the athlete could, for example, be manually inserted by the shooter or be obtained by suitable sensors installed in the area.

In some embodiments, the information necessary for the calculation of the point of impact, which includes the characteristics of the trap 12, the shooting pattern and the reaction time, may be manually entered by the user or automatically acquired by dedicated systems.

For example, the shooting pattern, the trap and the instant of release may be obtained via interface with the control unit 16 of the area, or via dedicated systems that poll the state of the machines and of the instrumentation.

The shooting instant may in the same way be obtained by direct interface with the control unit or by employing instrumentation dedicated to recognizing the event, for example with elements for sensing the noise or the acceleration, or other phenomena tied to the acts of shooting and/or calling for the clay target.

According to another aspect of the invention, the estimated trajectories of the clay targets that are presented according to the pattern that is set and the platform occupied by the shooter are displayed, for example on a monitor visible by the shooter, before the start of the shooting session.

In fact, in the sporting disciplines in which the possible trajectories are standardized by rule, the athletes may need to prepare for the shot by reviewing the characteristics of the clay targets that they will find themselves confronting, even if they do not know the sequence in which they will be presented.

The classic format present in the rules, i.e., the table that specifies the points of passage and the angulation, does not appear to be very intuitive, especially to untrained eyes.

Figure 7:
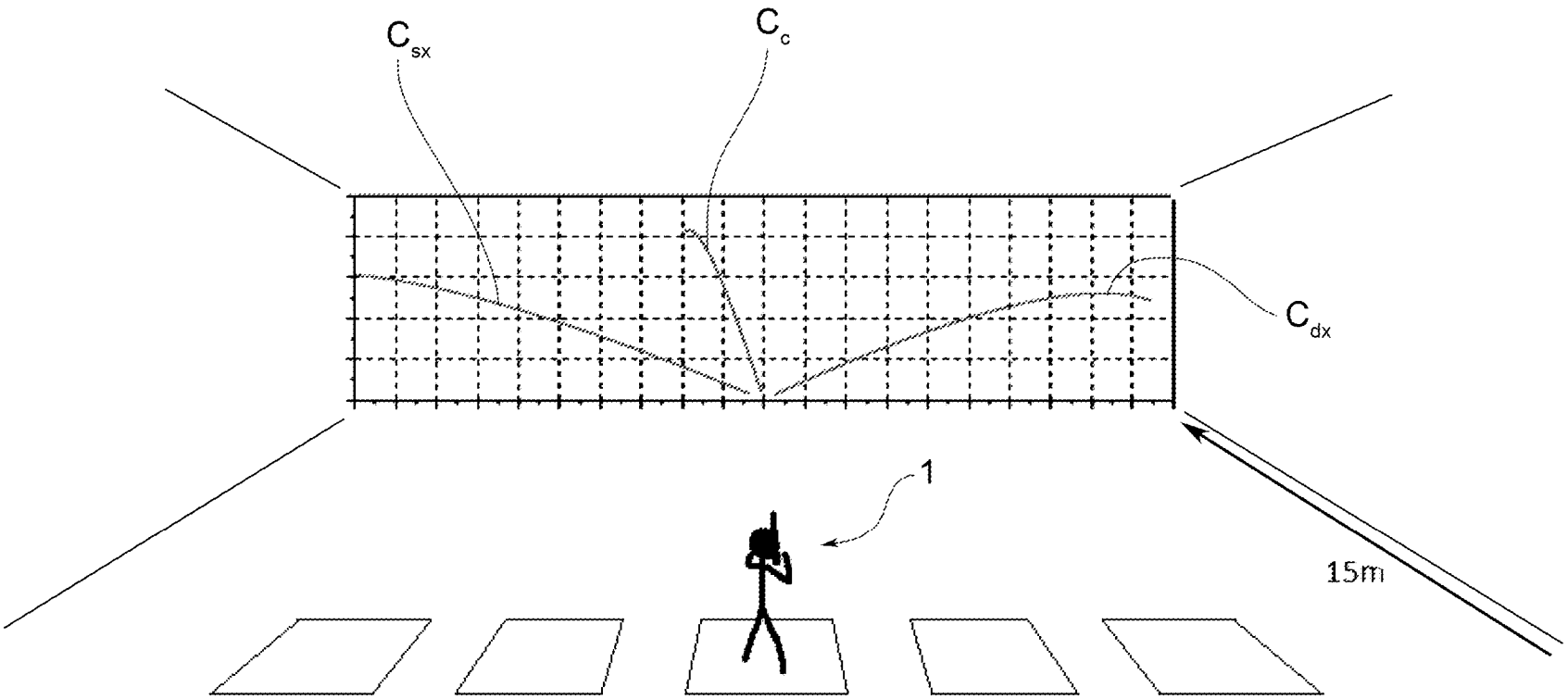
FIG. 7 is an example of how the trajectories might be presented to the shooter, via app, when the scheme and platform are varied, a few instants before the start of the shooting session.

The proposed method utilizes the trajectory models described above to supply a more complete and intuitive display technique of the clay target trajectories by means of graphical display of the path. For example, FIG. 7 shows three possible trajectories (left Csx, central Cc, right Cdx) that a shooter positioned on a central platform (for example of five shooting platforms) will find themselves confronting.

Figure 7A:
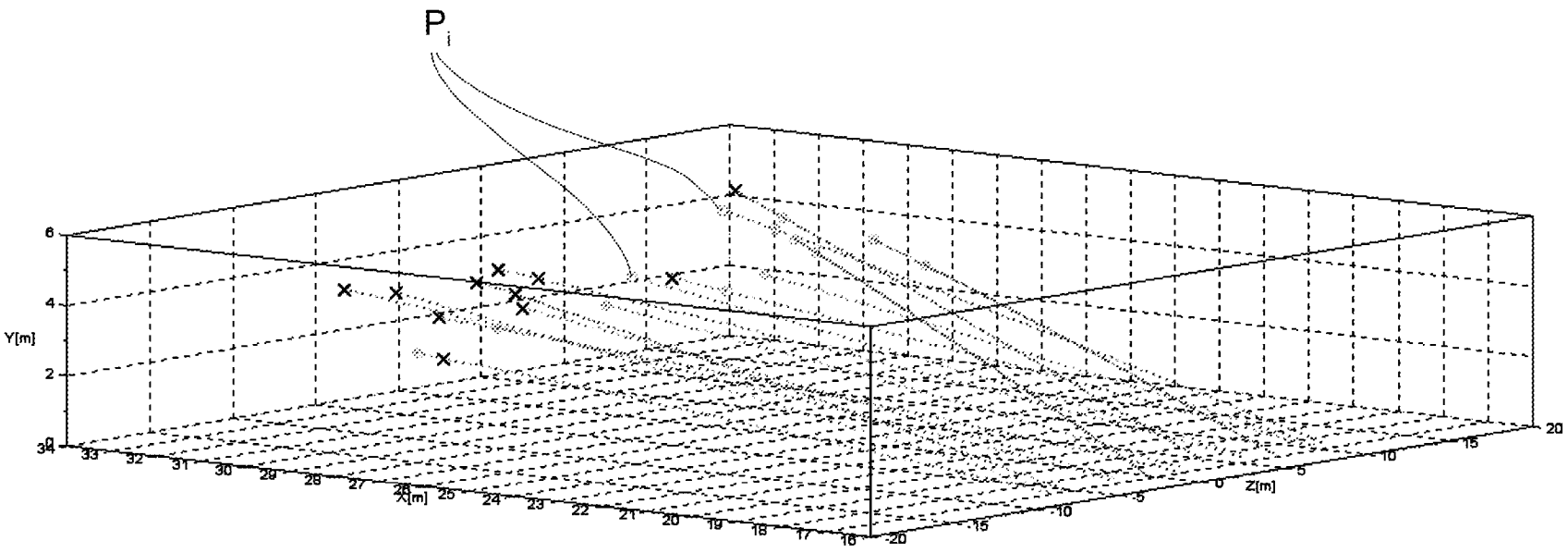
FIG. 7*a* is a 3D representation of trajectories of the clay target calculated after the shot, with indication of the point of impact with the shot.

FIG. 7*a* instead represents a 3D view of clay target trajectories calculated after the relative shots with an indication of the point of impact Pi (i.e., the point of intersection between the trajectory of the clay target and the trajectory of the shot) between clay target and shot (represented with a circle if the clay target was hit and with an "X" if the clay target was missed). Therefore, the shooter, after having carried out a shooting session, may review the trajectories of the launched clay targets and the point at which he/she has hit (or missed) the clay target on a monitor of the area or on one's own mobile device.

The trajectory may be shown from the point of view of the shooter, taking into consideration the point of view and the knowledge of the platform occupied by the shooter. The coordinates may in this case be angular coordinates or linear coordinates, like projection of the angular coordinates on an appropriately selected plane.

For example, the correction of the point of view necessitates that the following be taken into consideration:

- the height of the point of view of the shooter when he/she is in shooting position;
- the shooting station occupied by the shooter.

The height may be specific to the shooter who is benefiting from the service, or a value represented by an average user, while the shooting station influences both the shooter-machine distance and the point of view.

As described above, in the case of American trap, the point of view of the shooter should also be calculated as a function of the position assumed by the shooter among all those possible for this discipline.

According to another aspect of the invention, the calculation method of the coordinates of the point of impact between clay target and shot may be used for the calculation of the angulation of the shotgun.

In fact, for the collection of quantities related to the kinematics of the shotgun, measuring instruments that are installed on the weapon and sensitive to the movement, to the position or to the inclination, or instruments installed in the area which are able to monitor the position and orientation of the shotgun during the act of tracking the clay target. Even if measuring instrumentation makes it possible to accurately reconstruct the movement, the acquisition, installation and use of the instrumentation may turn out to be time-consuming for the user; furthermore, these systems are usually unavailable in the areas.

Figure 6:
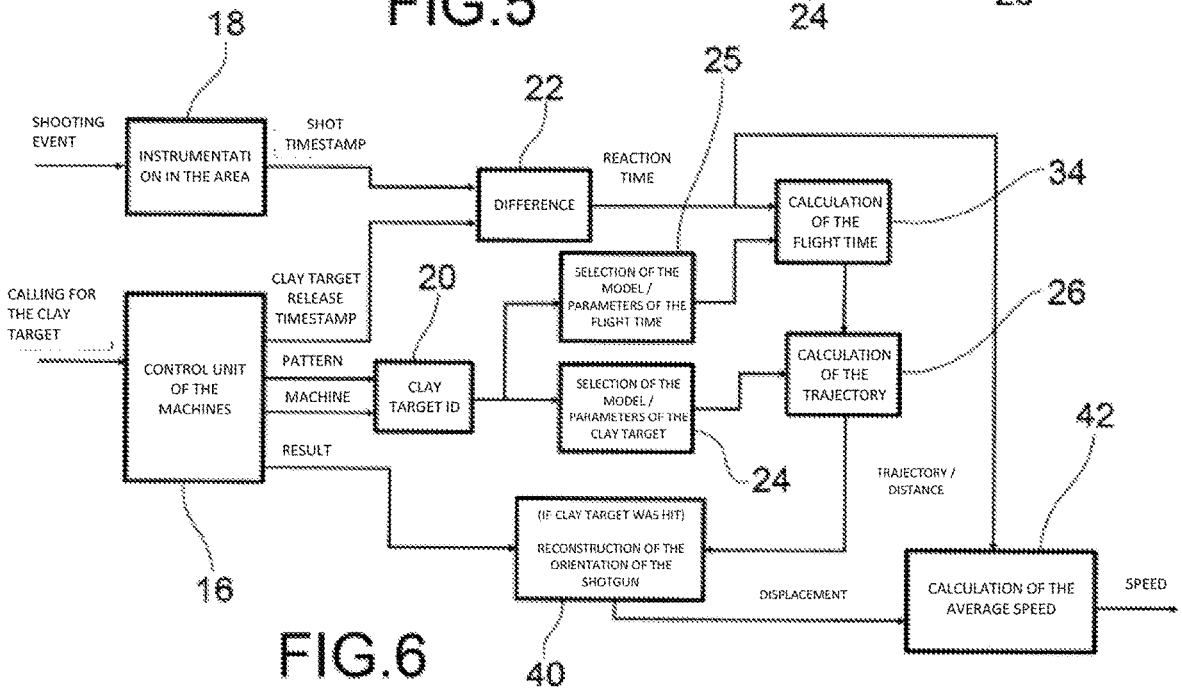
FIG. 6 is a block diagram of the method of calculating the speed of the shotgun when tracking the clay target.

The proposed method consists in the use of the information extracted from the trajectory model for the estimation of these quantities, if the type of clay target according to the shooting schemes, the reaction time and the result of the shot are known (see FIG. 6).

In one embodiment, the method of calculating the angulation of the shotgun comprises the steps of:

- acquiring the shooting position of the shooter and the shooter's height;
- acquiring the result of the shot;
- in the case of a clay target being hit, calculating the straight line which joins the coordinates of the shooting position and the coordinates of the point of impact;
- calculating the orientation of the shotgun upon firing the shot.

If the clay target was hit, there is the certainty that at the instant of the shot, in view of the high speed of the exiting pellets and the relative reduced distance (on average less than 40 m), the shotgun is aligned along a straight line which joins position of the shooter the clay target. Therefore, the calculation of the coordinates of the clay target at the instant of impact according to the methods described above, if the position and shooter's height are known, makes it possible to reconstruct the orientation of the shotgun upon firing the shot (phase 40 in FIG. 6).

Further refinements may be introduced taking into account the shooter's height and the length of the barrel.

Therefore, by utilizing the angular displacement of the shotgun and the reaction time, it is possible to know an estimate of the average speed when tracking with a displacement/time formula (step 42 in FIG. 6).

As mentioned above, the estimate of the average speed of the shotgun when tracking the clay target may be utilized in combination with the estimate of the distance between the shooter and the point of impact for refining the selection of the choke that is most appropriate for the characteristics of a specific shooter.

Furthermore, a selection system for selecting a choke from among a plurality of chokes that may be applied to the barrel of a shotgun during a skeet shooting session constitutes an object of the present invention.

In a general embodiment, the system comprises:

- a trajectory model acquisition module configured for acquiring a trajectory model of the clay target;
- devices for detecting shooting parameters configured for detecting at least the release time of the clay target from the launching machine and the shooting time;
- processing means operationally connected to the model acquisition module and to the devices for detecting shooting parameters and configured for:
  - obtaining the reaction time as the difference between the release time and the shooting time;
  - obtaining the spatial coordinates of the point of impact on the trajectory model at an impact time that includes the reaction time;
  - selecting a choke as a function of said impact distance or of an average of impact distances obtained from a plurality of estimates of the positions of the point of impact made after each one of a plurality of shots made.

In one embodiment the clay target trajectory model acquisition module is configured to acquire or calculate a physical model which describes the aerodynamic behavior of the actual clay target, at least the mass and geometry of which are known.

In one embodiment the shooting parameter detection devices are configured to detect the direction and intensity of the speed vector of the clay target exiting the trap. In this case, the physical model is calculated utilizing direction and intensity of the speed vector.

In one embodiment, the trajectory model acquisition module is configured for acquiring or calculating a parametric mathematical model that approximates a physical trajectory model.

In particular, the trajectory model acquisition module is configured for:

- calculating one or more clay target trajectory physical models;
- tabling the position coordinates of the clay target as a function of a time sampling of the physical model at predetermined intervals of time;
- obtaining the spatial coordinates of the point of impact from the table of the coordinates of the clay target at the time sampling instant closest to the impact time.

In one embodiment, the system further comprises measuring means capable of directly measuring the actual trajectory of the clay target. In this embodiment, the trajectory model acquisition module is operationally connected to the measuring means and is configured for calculating the trajectory model on the basis of the actual trajectory.

In one embodiment, the shooting parameter detection devices are configured for measuring the launch angle of the clay target with respect to a central axis of the shooting area, and/or measuring the lift angle of the clay target exiting the machine and/or measuring the launch speed of the clay target.

In one embodiment, the processing means are configured for calculating the impact time as the sum of the reaction time and the shot flight time.

In one embodiment, the processing means are configured for calculating the impact time as a point of intersection between the law of motion of the shot and the trajectory model of the clay target.

In one embodiment, the processing means are configured for calculating the shot flight time for various shooting instants for each clay target, so as to construct functions expressing either the flight time, or the impact time, as a function of the shooting time.

In one embodiment, the system also comprises:

- means of acquisition of the shooting position of the shooter and the shooter's height;
- means of acquisition of the result of the shot.

The processing means are configured for:

- calculating, in the case of a clay target being hit, the straight line which joins the coordinates of the shooting position and the coordinates of the point of impact;
- calculating the orientation of the shotgun upon firing the shot;
- calculating the average speed of the shotgun when tracking the clay target as the ratio of the angular displacement of the shotgun to the reaction time.

In this embodiment, the processing means are configured for making the selection of the choke also as a function of the average speed of the shotgun when tracking the clay target.

To summarize, the proposed method and the system thus make it possible to:

- obtain an indication of the average distance of engagement for first and second barrel, making it possible to optimize the degree of choking of the barrel as a function of the distances;
- have a graphical representation which describes the trajectory of the clay target and the orientation of the shotgun at the instant of the shot (for first and second barrel). The representation makes it possible for the shooter to better reconstruct the motion carried out and understand any errors committed;
- understanding the result of the shot, correlating the position data of the clay target with the result, makes it possible to identify the shooting zones which statistically are trickier for the shooter.

It is to be noted that the estimation of the point of impact between clay target and shot that is utilized in the present explanation for selecting the degree of choking of the barrel may be employed for other purposes, for example to correct any shooting errors or to select the trickiest trajectories of the clay target for the shooter, for example for optimizing the training sessions.

A person skilled in the art may, in order to meet contingent needs, make changes and adaptations to the embodiments of the method and of the system for selecting a choke for a shotgun for skeet shooting according to the invention, and replace elements thereof with other functionally equivalent ones, without departing from the scope of the following claims. Each of the features described as belonging to a possible embodiment may be obtained independently of the other described embodiments.

What is claimed is:

1. A method for selecting a choke from among a plurality of chokes to be applied to a barrel of a shotgun during a skeet shooting session, the method comprising:

- firing at least one shot;
- after each shot fired, estimating a position of a point of impact between a clay target released from a launching machine and a shot fired from the shotgun of a shooter;
- calculating an impact distance between a position of the shooter and the estimated position of the point of impact;
- selecting the choke as a function of said impact distance or as a function of an average of impact distances obtained from a plurality of estimates of the position of the point of impact made after each one of a plurality of shots made, wherein the estimate of the position of the point of impact is obtained with a method for estimating the position of the point of impact comprising:

acquiring a trajectory model of the clay target;

acquiring a release time of the clay target from the launching machine;

acquiring a shooting time;

obtaining a reaction time as a difference between the release time and the shooting time; and obtaining spatial coordinates of the point of impact on the trajectory model at an impact time that includes the reaction time, wherein the trajectory model of the clay target and the reaction time are automatically calculated based on information acquired by an electronic control unit of devices used for performing the skeet shooting session.

2. A system for selecting a choke from among a plurality of chokes to be applied to a barrel of a shotgun during a skeet shooting session, the system comprising:

a trajectory model acquisition module configured for acquiring a trajectory model of a clay target;

shooting parameter detection devices configured for detecting at least a release time of the clay target from a launching machine and a shooting time;

processing means operationally connected to the trajectory model acquisition module and to the shooting parameter detection devices and configured for:

obtaining a reaction time as a difference between the release time and the shooting time;

obtaining spatial coordinates of a point of impact on the trajectory model at an impact time that includes the reaction time; and selecting the choke as a function of an impact distance or as a function of an average of impact distances obtained from a plurality of estimates of a position of the point of impact made after each one of a plurality of shots made.

3. The system of claim 2, wherein the trajectory model acquisition module is configured to acquire or calculate a physical model which describes an aerodynamic behavior of an actual clay target, at least mass and geometry of the actual clay target being known.

4. The system of claim 3, wherein the shooting parameter detection devices are configured for detecting direction and intensity of an output speed vector of the clay target from a trap, and wherein said physical model is calculated utilizing said direction and intensity of the output speed vector.

5. The system of claim 3, wherein the trajectory model acquisition module is configured for acquiring or calculating a parametric mathematical model that approximates a physical trajectory model.

6. The system of claim 3, wherein the trajectory model acquisition module is configured for:

calculating one or more physical trajectory models of the clay target;

tabling position coordinates of the clay target as a function of a time sampling of the physical model at predetermined intervals of time; and obtaining the spatial coordinates of the point of impact from the table of the position coordinates of the clay target at a time sampling instant closest to the impact time.

7. The system of claim 2, further comprising measuring means suitable for directly measuring an actual trajectory of the clay target, the trajectory model acquisition module being operatively connected to said measuring means and being configured for calculating the trajectory model based on the actual trajectory.

8. The system of claim 2, wherein the shooting parameter detection devices are configured for measuring at least one of a launch angle of the clay target with respect to a central axis of a shooting area, a lift angle of the clay target exiting the launching machine, and a launch speed of the clay target.

9. The system of claim 2, wherein the processing means are configured for calculating the impact time as a sum of the reaction time and a shot flight time.

10. The system of claim 2, wherein the processing means are configured for calculating the impact time as a point of intersection between a law of motion of the shot and the trajectory model of the clay target.

11. The system of claim 9, wherein the processing means are configured for calculating the shot flight time for various shooting instants for each clay target, so as to construct functions expressing either the shot flight time, or the impact time, as a function of the shooting time.

12. The system of claim 2, further comprising:

means of acquisition of a shooting position of a shooter and a height of the shooter;

means of acquisition of a result of the shot;

wherein the processing means are configured for:

calculating, in the case of the clay target being hit, a straight line which joins coordinates of the shooting position and the spatial coordinates of the point of impact;

calculating an orientation of the shotgun upon firing the shot; and calculating an average speed of the shotgun when tracking the clay target as a ratio of an angular displacement of the shotgun to the reaction time.

13. The system of claim 12, wherein the processing means are configured for making the selection of the choke also as a function of the average speed of the shotgun when tracking the clay target.

* * * * *